US006468373B1

(12) United States Patent
Grinwald et al.

(10) Patent No.: US 6,468,373 B1
(45) Date of Patent: Oct. 22, 2002

(54) METHOD OF MAKING A LIGHTED BACKBOARD ASSEMBLY

(75) Inventors: Anthony G. Grinwald, Rubicon; Jeff D. Breitzman, Sussex, both of WI (US)

(73) Assignee: Huffy Corporation, Miamisburg, OH (US)

( * ) Notice: Subject to any disclaimer, the term of this patent is extended or adjusted under 35 U.S.C. 154(b) by 0 days.

(21) Appl. No.: 09/553,668

(22) Filed: Apr. 20, 2000

(51) Int. Cl.[7] ..... B32B 31/00

(52) U.S. Cl. ..... 156/82; 156/272.6; 156/293; 473/415; 473/479; 473/481

(58) Field of Search ..... 473/415, 479, 473/481; 156/153, 272.6, 82, 293

(56) References Cited

U.S. PATENT DOCUMENTS 4,478,415 A * 10/1984 Shaffer et al. ..... 473/481
5,305,998 A * 4/1994 Nesbit et al. ..... 473/481
5,346,207 A * 9/1994 Heinen ..... 473/481
5,916,048 A * 6/1999 Hurrell et al. ..... 473/479
6,004,231 A * 12/1999 Schickert et al. ..... 473/481

OTHER PUBLICATIONS

Shields, J, "Adhesives Handbook", CRC Press, 1970, pp. 244–245.*

* cited by examiner

*Primary Examiner*—Jeff H. Aftergut
(74) *Attorney, Agent, or Firm*—Howrey Simon Arnold & White, LLP; Michael J. Bell; Anthony L. Meola

(57) ABSTRACT

A molded frame backboard assembly is disclosed including a unitary molded plastic frame and rebounding surface bonded thereto. The frame preferably is formed as one piece of plastic material having sufficient strength and rigidity to support the rebound surface and may include an internal reinforcing structure integrally molded therewith. The rebounding surface preferably is an acrylic sheet bonded at its edges to the peripheral edge of the frame. The peripheral edge of the frame is raised to support the rebounding surface such that, when attached, the rebounding surface sits flush with the peripheral edge of the frame so that the edges of the rebounding surface are not left exposed. The rebounding surface is bonded to the frame by flame treating or corona treating portions of the frame and applying an adhesive bonding material such as silicon thereto to secure the rebounding surface to the frame. A cavity is formed between the rebounding surface and the frame within the interior portion of the frame. The cavity can thereby be used for structural, design, and/or ornamental purposes.

23 Claims, 6 Drawing Sheets

METHOD OF MAKING A LIGHTED BACKBOARD ASSEMBLY

BACKGROUND OF THE INVENTION

1. Field of the Invention

The invention relates generally to basketball backboards and, in particular, to a lighted backboard with an acrylic rebounding surface that is supported by and adhesively bonded directly to a molded plastic frame.

2. Description of Related Art

There is a great variety in basketball backboard designs and materials available today. Some of the various backboard designs include a rebounding surface that is supported by a rear frame, which may be composed of wood, metal, or plastic. Some designs include rebounding surfaces composed of glass or plastic that are supported by a frame surrounding the periphery of the rebounding surface.

As basketball and basketball apparatuses have become more popular, additional designs have become popular. Among the most popular designs are those that use plastic rebounding surfaces. Plastic rebounding surfaces provide greater flexibility of design, lighter weight, and easier construction; however, they typically must be supported by complex, heavier-duty frames to withstand the ordinary wear-and-tear to which basketball equipment is subjected. In addition, backboards that employ plastic or acrylic rebounding surfaces often suffer cracking and separation from the frame during ordinary use.

Many basketball backboards are produced using a moldable plastic material to construct the frame. Blow molding has become a popular method of producing basketball backboards and related parts of basketball goal assemblies because of its efficiency and flexibility in the molding process. Other processes such as injection, compression and roto-molding may provide similar results.

Molded plastic frames provide certain obvious advantages over steel and aluminum frames. For example, molded plastic frames are cheaper to produce, lighter in weight, and allow for more creative designs. In addition, plastic backboard frames can be molded in configurations that result in substantially fewer parts to assemble. Unfortunately, molded plastic frames are typically less structurally sound than their metal counterparts. Prior art backboards that employ molded plastic frames often suffer from structural problems such as cracking and separation of the rebound surface from the frame.

One existing backboard design solves some of the structural deficiencies of prior art molded plastic backboards by using a two-piece frame encapsulating a rebound surface. The frame is formed by separately moldable front and rear sections such that the rebound surface is supported between the frames, and the peripheral edge of the rebound surface is completely encapsulated. The rear frame member also may include an internal reinforcing structure integrally molded therewith to further enhance the strength and rigidity of the rear frame.

While the two-piece encapsulated backboard indeed produces a structurally sound backboard that prevents cracking of the rebound surface, it is always more desirable to produce a backboard of equal quality and durability while employing fewer parts. To that end, other existing backboard designs employ a one-piece molded plastic frame with a rebound surface mounted thereon. These designs tend still to suffer from cracking and separation of the rebound surface.

The disadvantages of these one-piece designs usually result from inferior design of the supporting frame structure and inadequate attachment of the rebound surface to the backboard frame.

Another disadvantage associated with prior art one-piece molded plastic backboards, is that they generally do not allow for as much creativity of design as do multi-piece backboards. One-piece backboards must possess the structural strength of multi-piece backboards in order to function similarly. Therefore, their ornamental features are usually limited to decorating the rebounding and surrounding surfaces, such as with in-molded graphics on the rebounding surface. However, as basketball increases in popularity, there is a need for backboards with features such as lights which allow nighttime play. Multi-piece designs provide more flexibility for designers to employ decorative features within the backboard frame itself to give backboards more interesting three-dimensional qualities. But as stated above, multi-piece designs have their own disadvantages including increased cost and weight, and added complexity in manufacturing and assembly.

Therefore, there is a need for a lightweight, yet durable basketball backboard that exploits the advantages of molded plastic frames, particularly multi-piece molded plastic frames, in a one-piece backboard frame. The one-piece backboard frame would exploit such advantages as lighter weight and ease of manufacturing and assembly, while also providing for advantages heretofore associated only with multi-piece backboards, such as increased structural strength and greater flexibility in design. To accomplish this, a new process is needed to form a better backboard assembly by more strongly and efficiently assembling the frame and rebound surface, while still allowing for enough flexibility of design to add features such as lights.

SUMMARY OF THE INVENTION

The invention meets these needs and avoids the disadvantages and drawbacks of the above-described prior art by providing a basketball backboard preferably having a unitary molded plastic frame for supporting a rebound surface. The frame is formed of a single moldable piece that supports a rebound surface that is preferably an acrylic sheet. The rebounding surface is bonded directly to the frame in a manner that improves its ability to withstand the rigors of basketball play.

The frame may be formed through a blow molding process with the acrylic sheet rebound surface being bonded to the frame. Use of the blow molding process ensures that the frame has sufficient strength and rigidity to support the rebound surface and provides rebounding performance that matches or exceeds that of the highest quality metal and multi-piece plastic frame backboards. The frame may also include an internal reinforcing structure integrally molded therewith to further enhance the strength and rigidity of the rear frame.

The frame preferably has a raised peripheral edge extending about the periphery of the backboard frame such that the rebound surface is bonded to the frame around the periphery. The peripheral edge of the frame can be flame treated or corona treated and an adhesive material such as silicon applied thereto to bond the rebounding surface directly to the frame's peripheral edge. Compression may then be used to facilitate the bonding process. By bonding the acrylic rebound surface to the peripheral edge of the frame, the rebound surface can be disposed such that its outer edge is inlaid within the periphery of the frame. Thus, the edges of the rebound surface are protected from the cracking problems that plague prior backboard designs where the rebound surface extends to the edge of the frame. Moreover, the need for a multi-piece frame for encapsulating the rebound surface edges is avoided.

When the peripheral edge of the frame is raised, with respect to the interior of the frame, and the acrylic sheet is bonded to the frame's peripheral edge, a cavity may be formed behind the interior portion of the rebound surface. This interior cavity may be used for structural purposes to absorb and dampen forces imparted to the frame when balls and players strike the rebound surface. The interior cavity may also be used to add features to the backboard, such as illustrations or lights for evening use or decoration.

Preferably, the frame also includes a slotted structure particularly adapted to connect the backboard to a backboard support mechanism. Preferably, the slot receives the head of a mounting bolt for the backboard support mechanism. However, the slot may be formed as a keyhole slot, which has a predetermined extent less than the extent of the frame. Thus, the mounting bolts may rest on a ledge defining one end of the slot to facilitate assembly. The entire backboard assembly may be connected to a support pole that is part of a fixed, in-ground, basketball assembly, or part of a portable basketball assembly. Moreover, the backboard assembly may be secured to the pole through any of a wide variety of methods that allow for the backboard assembly to be in a fixed position with respect to the pole, or adjustable in height and position.

The invention thus provides new and significant advantages over the prior art. The molded plastic construction of the backboard frame enables the frame to be lightweight and durable without compromising strength or rigidity. The rebound surface is bonded to the frame such that there are no exposed edges, which can be susceptible to cracking. Because the backboard assembly is formed primarily from two separately moldable parts, assembly of the invention is quickly accomplished. Thus, the invention provides a lightweight backboard that is easier to manufacture and assemble than heretofore possible while maintaining or surpassing the performance of prior backboards.

DETAILED DESCRIPTION OF THE PREFERRED EMBODIMENTS

Figure 1:
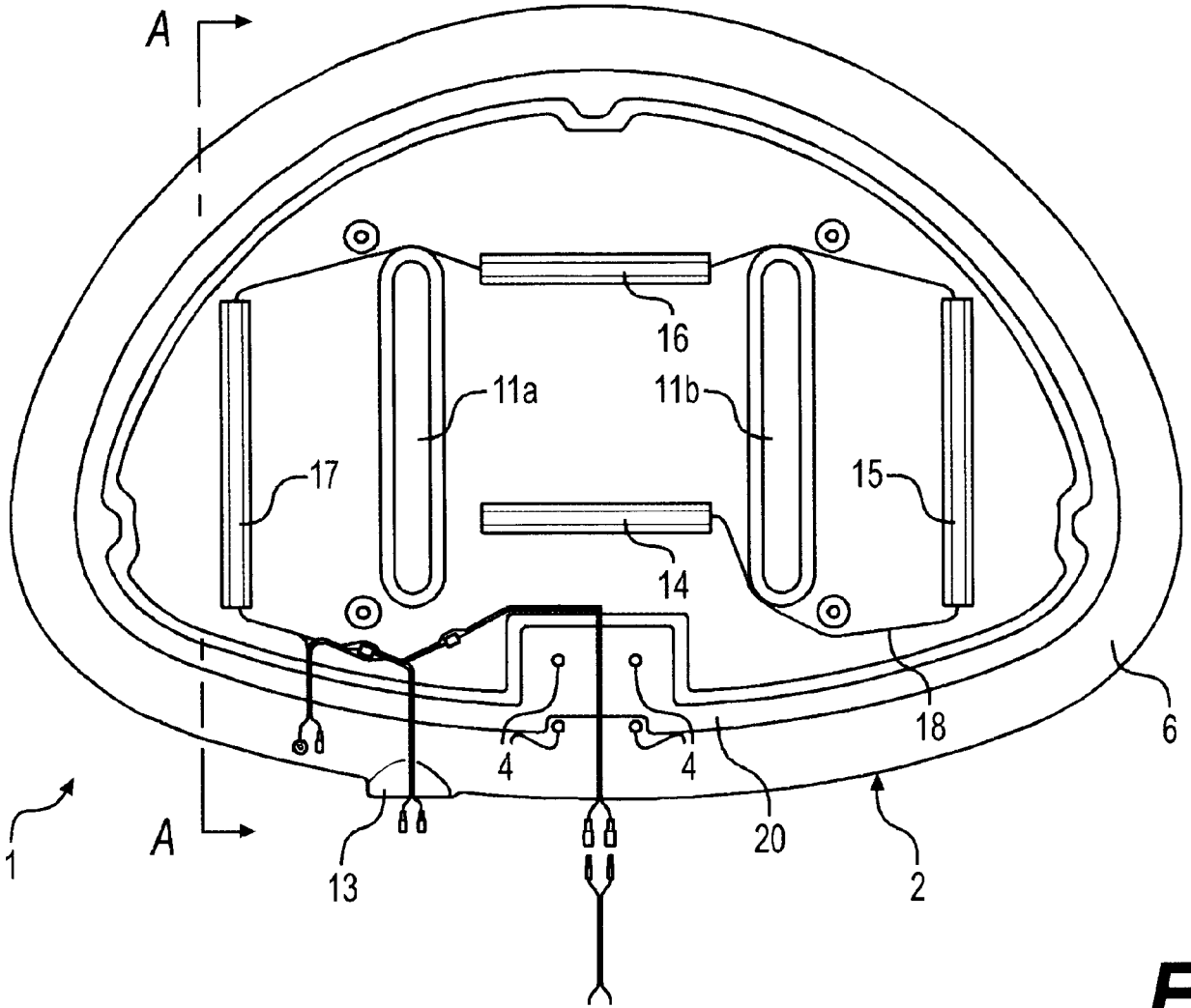
FIG. 1 is a front view of the preferred embodiment of the present invention.

Referring first to FIG. 1, the preferred embodiment of the invention is shown wherein backboard assembly 1 includes a molded plastic frame 2. As will be described in more detail below, frame 2 is preferably molded from polyethylene, polycarbonate, or a similar material using blow molding, compression molding, or any other well-known molding technique. Although FIG. 1 depicts a backboard that is generally fan-shaped, other shapes may be employed easily since plastic molding techniques permit a wide variety of shapes, contours, and designs.

Figure 2:
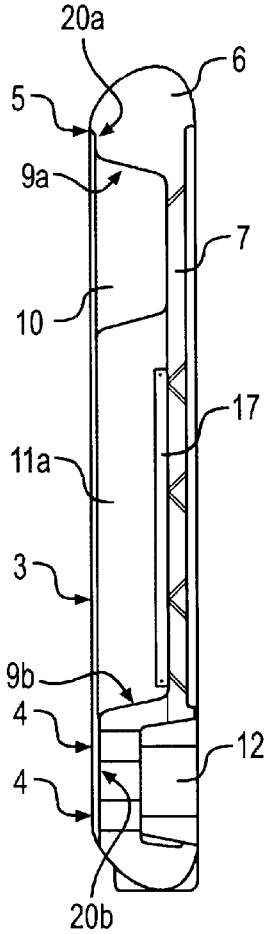
FIG. 2 is a cross-sectional view of the preferred embodiment taken along cut-line A—A in FIG. 1.

In the preferred embodiment, frame 2 is molded such that its peripheral edge 6 is raised. In other words, the border surrounding the frame is thicker from front to back than the interior portion of the frame. This preferred configuration is best viewed in the side-view of FIG. 2 taken along cut-line A—A in FIG. 1. As can be seen in FIG. 2, the frame has a raised edge 6 surrounding the outer periphery of the frame. The interior portion is not as thick. For example, in FIG. 2 rear wall 7 of the frame is depicted as being approximately one-third the thickness of the raised peripheral edge 6. Of course, exact dimensions may vary widely. The thickness of the raised peripheral edge with respect to the rear wall or any other portion of frame 2 may be altered as desired. Additionally, the peripheral edge need not be raised around the entirety of the frame's peripheral edge. One skilled in the art of plastic molding techniques can easily create a frame with differing dimensions in accordance with the principles of the present invention.

Returning now to FIG. 1, a basketball goal, usually in the form of a metal rim or hoop with a net attached thereto, may be mounted to the backboard by way of mounting holes 4 in any of a variety of well known manners. FIG. 1 shows four mounting holes 4; however, more or less may be employed depending upon particular applications and design criteria. Mounting holes 4 provide the openings in the front face of the backboard in which the bolts can be inserted into the frame 2. Moreover, mounting holes 4 need not be round or symmetrically located, as shown in FIG. 1. There are a great many possible configurations for mounting a rim to frame 2. In the side view of FIG. 2, the bore holes for mounting holes 4 are shown. A basketball rim is preferably mounted using screws or bolts, however, many other well-known attaching methods and devices may be used to secure a rim to frame 2. Thus, the configuration of the bore holes of mounting holes 4, including their depth and position, will vary depending upon the way in which the rim is attached to the backboard.

Figure 4:
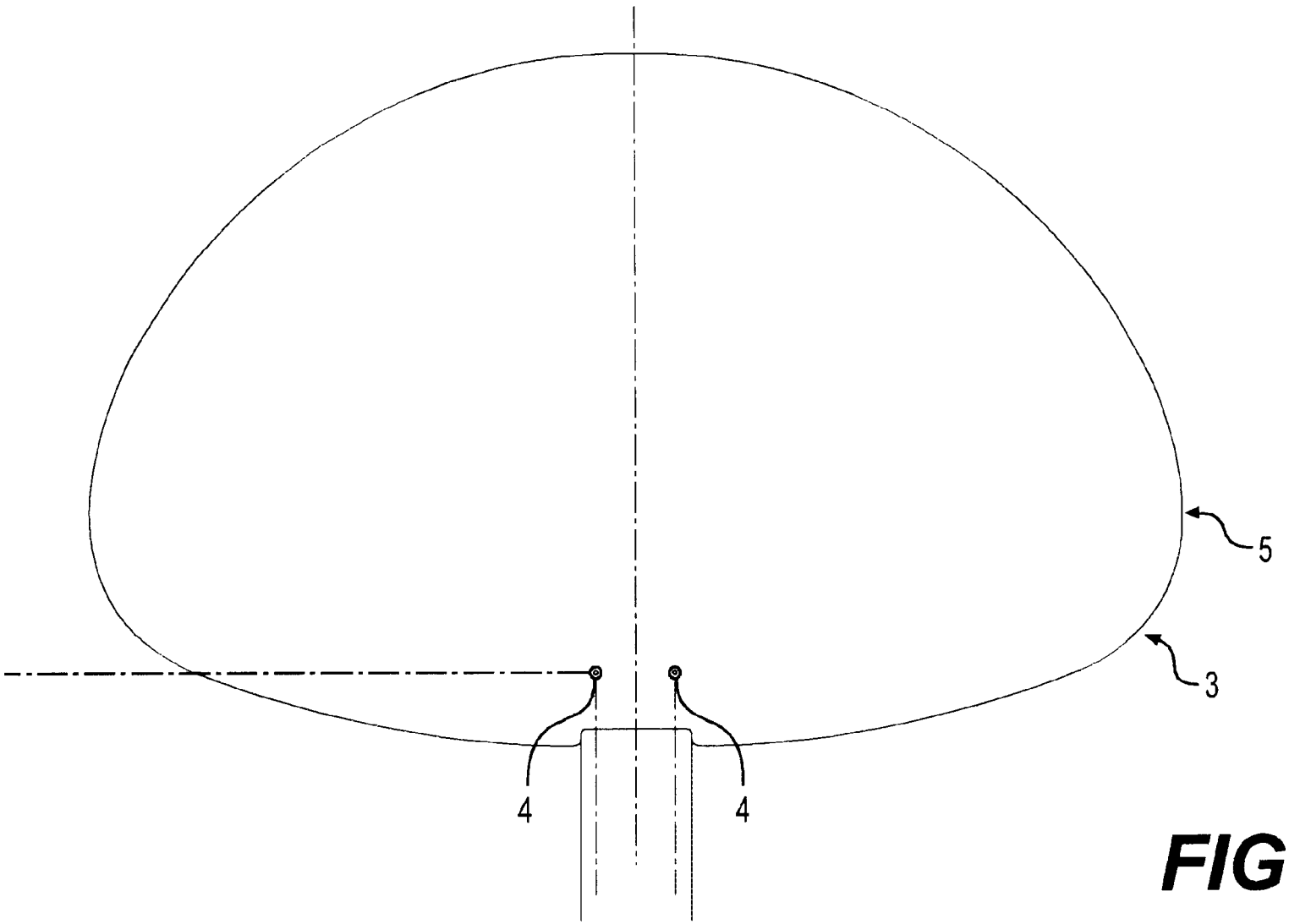
FIG. 4 is a front view of the rebound member of the preferred embodiment.

Considering FIGS. 2 and 4, rebound surface 3 is a substantially planar sheet or substrate and may have a range of thicknesses depending upon the particular rebounding characteristics desired, as is well known in the art. FIG. 2 shows rebound surface 3 in its preferred position secured to frame 2. FIG. 4 shows rebound surface 3 standing alone. Rebound surface 3 is preferably formed from a molded plastic, such as acrylic or polycarbonate. Acrylic is the preferred type of thermoplastic used in the invention and it may be clear, tinted, opaque, or any combination thereof. The rebound surface 3 should have sufficient rigidity when assembled with the frame to rebound a basketball tossed against the backboard assembly 1. Rebound surface 3 should also be able to withstand direct blows from players, as well as from basketballs.

FIG. 2 shows that rebound surface 3 has an outer peripheral edge 5, which as will be described in more detail below, may be bonded to frame member 2 along the frame's peripheral edge 6. Moreover, in the preferred embodiment of the invention, frame peripheral edge 6 is raised but comprises a tiered portion or ledge 20. The side view of FIG. 2 shows an upper ledge **20*a* along the upper portion of the frame's peripheral edge 6, as well as a lower ledge 20***b* along the lower portion of the frame's peripheral edge. The upper and lower ledges 20*a* and 20*b* are preferably two portions of a single ledge that extends about substantially the entire circumference of frame peripheral edge 6. For example, in FIGS. 1 and 5, a tiered ledge 20 is shown that extends about the entire periphery of the backboard frame. Preferably, ledge 20 extends approximately 1 inch inward from peripheral edge 6. However, these dimensions may vary in other embodiments, and may vary at different points about the frame's periphery. FIG. 1 shows that ledge 20 is slightly wider at several points about the frame periphery such as at the base of the frame where a basketball goal would be mounted. Specifically, in FIG. 1, ledge 20 is wider at the base of frame 2 to incorporate mounting holes 4.

The tiered shape of frame peripheral edge 6 is such that, when rebound surface 3 is bonded thereto, the rebound surface peripheral edge 5 is inlaid with the frame peripheral edge 6. As a result, rebound surface 3 is flush with a portion of the frame's peripheral edge 6 and consequently, the rebound surface peripheral edge 5 is not exposed. Thus, the rebound surface peripheral edge 5 is less susceptible to cracking and separation—a common problem in prior art backboards. The tiered configuration is not necessary. However, in the preferred embodiment, it serves to prolong the life of the rebound surface 3.

The dimensions of the ledge 20 portion may vary as desired. But as noted above, the size of ledge 20 may vary at different locations along the frame's peripheral edge 6. For example, FIG. 2 depicts the lower ledge 20*b* being larger than the upper ledge 20*a*. In the preferred embodiment, this configuration permits the rebound surface 3 to extend below mounting holes 4 such that, when a basketball rim is secured to the backboard, the bolts or other attaching means will pass through the rebounding surface 3 and into mounting holes 4 in frame 2. As a result, the rebound surface 3 is further secured to frame 2. By allowing rebound surface 3 to extend below mounting holes 4, more surface area is provided to bond rebound surface 3 to frame 2. Those skilled in the art will recognize that this arrangement is not necessary; the backboard could be designed such that rebound surface 3 does not extend below the mounting holes 4. However, the preferred configuration is particularly advantageous because it prolongs the life of rebound surface 3 and promotes a generally stronger backboard.

Frame member 2 is formed as a relatively rigid, unitary piece of molded plastic which may be made by any known molding process including injection molding, compression molding, blow molding, roto-molding, resin transfer molding and reaction injection molding, for example. In addition, the plastic may be molded using one of these processes in combination with a strength-enhancing technique like structurally foaming the plastic, reinforcing it with fiberglass or the like, or by using gas assist.

Frame member 2 preferably has a width of approximately 45 inches and a height of approximately 30 inches. Frame member 2 is constructed of polyethylene plastic made by blow molding. Of course, the dimensions of the frame and backboard can vary in size, thickness, and shape, depending upon the desired design. Use of the blow molding process enables the frame 2 to be molded in colored plastic, which is resistant to fading or paint chipping as compared with painted steel frame assemblies. Protective coatings may also be applied to the frame 2 and rebound surface 3 to protect the backboard assembly from harmful environmental effects.

Furthermore, as a result of forming the frame 2 of the invention as a molded structure, it may be formed with different shapes (other than the general fan-shape shown) which could not have been conveniently provided by prior metal frames. For example, the frame 2 of the invention may have a cross-sectional or contour shape which varies around the periphery of the backboard to give the backboard a desired visual appearance. It can easily include other ornamental features such as grooves and contours.

Frame member 2 is a single molded plastic piece. As best viewed in FIGS. 2 and 3, a rear wall 7 provides structural support for frame 2. Rear wall 7, which is preferably about 1 inch in thickness, may be structurally reinforced by any of the reinforcing methods described above. Rear wall 7 also may include slots 8 (see FIG. 3), preferably formed as round or key-way slots, that cooperate with bolts for attaching the backboard assembly to a support structure. Slots 8 are integrally molded within rear wall 7 and are adapted to receive and retain the head of a carriage bolt or similar fastener to be connected in a manner known in the art to a support such as an extension arm, or elevator for supporting the backboard on a pole, or similar structure. Other configurations may be employed to secure the backboard to a suitable support device including an in-ground pole, a pole from a portable support, or a wall or other fixed structure.

In one embodiment of the present invention, backboard assembly 1 may be mounted upon a portable basketball system. One example of a portable basketball support system that may be used with the backboards of the present invention is disclosed in the assignee's U.S. Pat. No. 5,207,407 entitled Portable Base for Basketball Support Pole and assignee's copending application, entitled Portable Basketball Support System With Separate Ballast Tank, the disclosures of which are hereby incorporated by reference.

In the preferred embodiment of the invention, securing rebound surface 3 to the raised peripheral edge 6 of frame 2 results in a cavity 10 being formed behind rebounding surface 3. Cavity 10, which is best viewed in FIG. 2, results from the use of rear wall 7 that is of a lesser thickness than raised frame peripheral edge 6, and that rebound surface 3 is a substantially planar sheet resting upon the raised peripheral edge 6. Consequently, a cavity is formed that is bounded by rear wall 7, rebound surface 3, and cavity sidewalls 9*a* and 9*b*. Cavity sidewalls 9*a* and 9*b* indicate the height to which frame peripheral edge 6 rises above frame rear wall 7. Therefore, the height of sidewalls 9*a* and 9*b* determines the depth of cavity 10. Since frame member 2 is a unitary molded plastic piece, the height and shape of sidewalls 9*a* and 9*b*, and thus, the size and shape of cavity 10, can easily be varied in the molding process.

Cavity 10 can be used for structural or design characteristics, or for ornamental purposes. In terms of structural benefits, cavity 10 may be designed such that rebound surface 3 absorbs the impact of basketballs that strike the rebound surface. Reinforcing projections or ribs may be integrally formed as part of frame 2 that, for example, extend from rear wall 7 through cavity 10 to support rebound surface 3. Such a support feature is visible in FIG. 1 as support projections 11*a* and 11*b*. Supporting projections and similar reinforcing ribs that are integrally formed as part of frame 2 may be employed to support the rebound surface and reduce vibrations. In the preferred embodiment of FIG. 1, support projections 11*a* and 11*b* are integrally formed with frame 2 and are the same thickness as the frame's raised peripheral edge 6, such that rebound surface 3 can lie flat being equally supported by peripheral edge 6, and supports 11*a* and 11*b* (see FIG. 2). It should be apparent that the number, size, shape, position, and location of support structures can be varied to accommodate particular applications and designs.

Cavity 10 may also be employed for ornamental reasons. For example, designs, lights and other decorative features may be placed within the cavity 10 to add a unique look to the backboard assembly. In the preferred embodiment of the invention, light elements 14, 15, 16, and 17 consisting of well-known LEDs are placed in cavity 10; but other well-known lighting elements of varying shapes and varieties such as lighted polymer strips, may be employed. The light elements 14, 15, 16, 17 may serve to light-up the backboard from behind for better visibility, or merely for ornamental benefit. The light elements 14, 15, 16, 17 may be of various colors, thus giving the backboard a unique decorative look. The light elements may be straight and elongated as shown in FIG. 1, or they may be variously curved or shaped to achieve the desired effect. Although this embodiment employs lights, other decorative features and effects may be employed.

Figure 3:
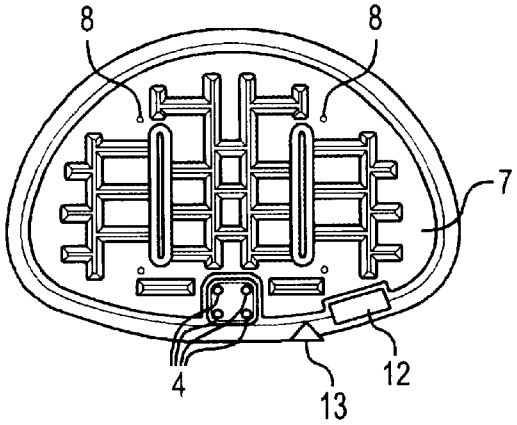
FIG. 3 is a rear view of the preferred embodiment.

If light elements or other items that require electrical power are employed, a battery holder 12 may be formed in the backboard frame 2, preferably on the backside of frame peripheral edge 6, as depicted in FIG. 3. Battery holder 12 would contain the batteries and necessary wiring to supply electrical power to the light elements. Forming battery holder 12 into the rear of frame peripheral edge 6 is preferable so that it can avoid direct hits from basketballs and players during use. In addition, an ON-OFF switch 13 may be employed with this embodiment so that the lights can only be lighted when desired, thus prolonging useful battery life. In the preferred embodiment, switch 13 is positioned on the bottom and back side of frame 2; however, switch 13 could be positioned anywhere. The requisite wiring 18 between battery holder 12, switch 13, and light elements 14, 15, 16, 17 may be contained within the lower portion of frame peripheral edge 6 to the extent possible, thereby protecting it from damage that could result if the wiring were exposed. Other portions of wiring 18 may be enclosed in cavity 10, since cavity 10 is completely enclosed in this embodiment. However, a more visually appealing design may involve passing the necessary wires to the lighted polymer element within the rear wall 7, thus keeping the wiring hidden.

As mentioned above, rebound surface 3 is bonded to frame member 2 to produce a structurally sound backboard assembly requiring only two pieces. The preferred process of making the backboard assembly involves first blow molding the polyethylene frame in the desired shape. As stated above, other processes beside blow molding may be used. In addition, strength reinforcing techniques known in the art may also be employed. Once the frame has been formed with the raised peripheral edge 6, ledge 20 is flame treated to prepare it to accept the bonding agent. Flame treating of the polyethylene ledge involves applying an intense heat, such as with a blowtorch, to the surface to be flame treated. The surface is thus heated up until it becomes more porous and permeable. By making the surface of the frame more porous, it will more deeply bond with the adhesive/sealant material to be applied. Consequently, a stronger bond results. As a result, when the bonding agent is applied, it is more readily absorbed by the polyethylene so that the bonding agent bonds with the internal structure of the frame's peripheral edge 6.

As an alternative to flame treating, corona treating may be used. Corona treating is a very effective way to prepare a surface for bonding because it increases the surface tension of virtually any material without visibly changing its appearance. The result is a surface that is more receptive not only to adhesives, but also to coatings and inks. To corona treat a surface, first the material being treated is exposed to an electrical discharge, or "corona". This corona may be supplied by an electrical arc or plasma torch, for example. Oxygen molecules within the discharge area break into their atomic form and are free to bond to the ends of the molecules in the material being treated. The result is a chemically-activated surface ready to receive the adhesive agent.

Figure 5:
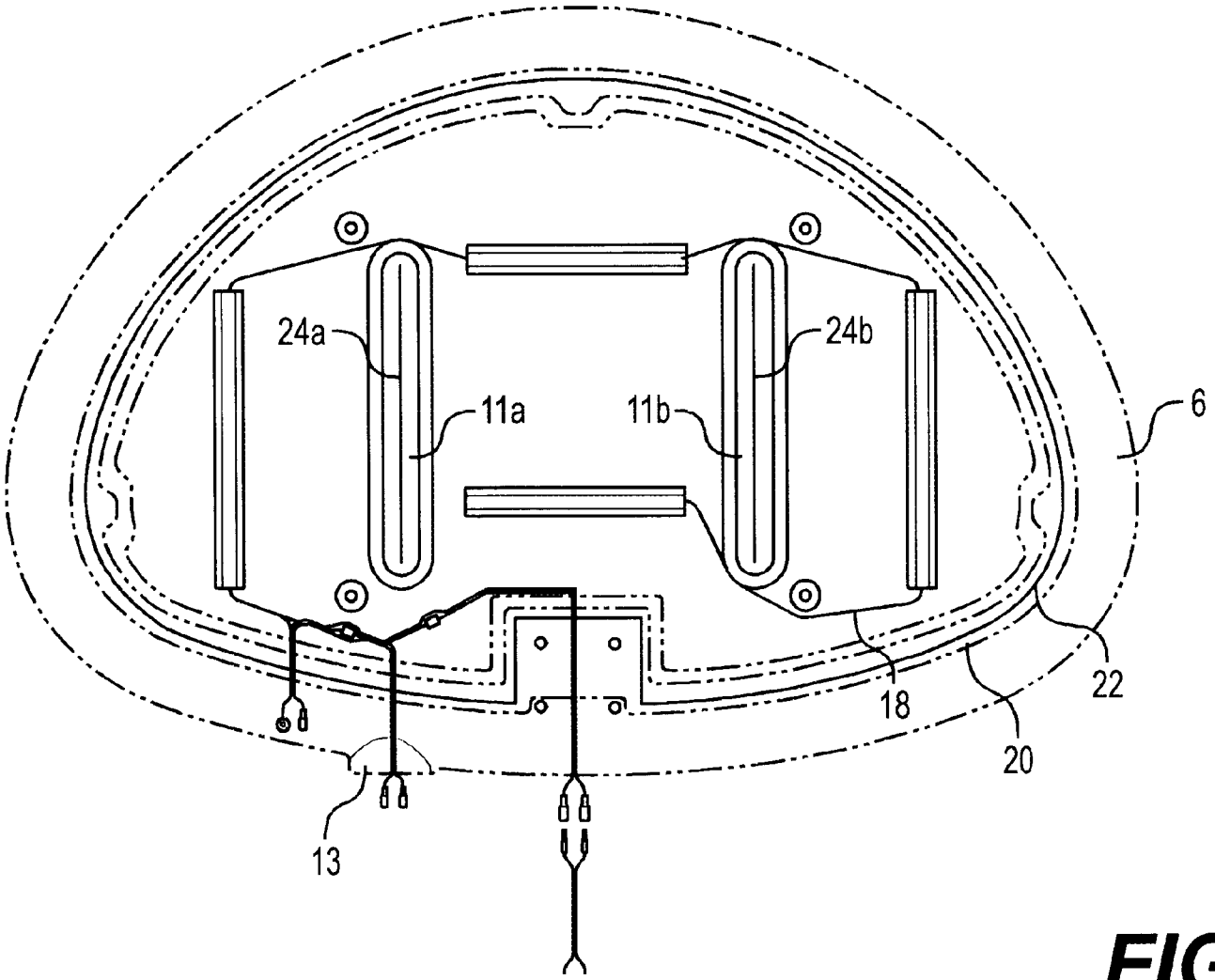
FIG. 5 is a front view of an alternative embodiment of the present invention.

The preferred bonding agent is a silicon adhesive—of which there are numerous commercially available types—but other bonding agents suitable for bonding plastics may be used. One such adhesive/sealant is a Room Temperature Vulcanization ("RTV") silicon; commercially-available versions of which include Loctite's Clear RTV Silicon. An RTV silicon is the preferred adhesive/sealant for its waterproof and weather-resistant characteristics. In addition RTV silicones have the processing advantage of curing at low temperatures; therefore, the sealant can cure at room temperature. Other adhesive sealants such as a non-silicon (preferably clear) sealant, contact cement or epoxy may also be used. FIG. 5 depicts the preferred placement for the adhesive 22 with respect to ledge 20. In addition, if support structures 11*a* and 11*b* are employed, they may also be flame or corona treated with adhesives 24*a* and 24*b* applied thereto, as shown in FIG. 5, to further secure rebound surface 3 to frame 2.

The acrylic sheet rebound surface 3 must also be prepared before bonding. Specifically, the outer peripheral edge 5 of rebound surface 3 must be prepared for bonding to ledge 20 of the frame. Peripheral edge 5 preferably includes approximately 1 inch of the surface of rebound member 3 that will be in direct contact with ledge 20. Of course, the size and dimensions of peripheral edge 5 that must be prepared for bonding to ledge 20 depend in part on the dimensions of ledge 20.

The rebound surface 3 may be prepared using well known solvents, solvent-based inks or accelerators, thus enabling the rebound surface to be properly bonded to the frame's peripheral edge 6. In addition, the acrylic sheet may be corona treated, as described above with respect to frame peripheral edge 6. Once frame 2, rebound surface 3, and if necessary, support structures 11*a* and 11*b*, have been prepared for bonding, rebound surface 3 is placed in the proper position resting upon ledge 20 of peripheral edge 6.

Compression may be used to facilitate the bonding process. Once the adhesive material has been applied and the rebound surface 3 has been properly placed on frame 2, the two components may be held or forced together to ensure that adequate bonding takes place. In a simple example, the frame may be situated on its rear side with weights being placed on top of the rebound surface 3 to force it down on frame 2. Such an arrangement would result in a tighter bond between frame 2 and rebound surface 3.

As stated above, a basketball rim is typically secured to the backboard by way of bolts, screw, or other attaching devices and methods. FIGS. 6–10 relate to alternative embodiments of the present invention involving rims. More specifically, if as described above, an arrangement of battery-operated lights is employed to add distinctive effects to the backboard, this concept can be expanded to include the rim. For example, a lighted rim could be secured to the lighted backboard. One method of doing this is to employ a light element such as a flexible light conducting tube, such as a poly-optical uniglow lamp, mounted about the circumference of the rim.

Figure 6:
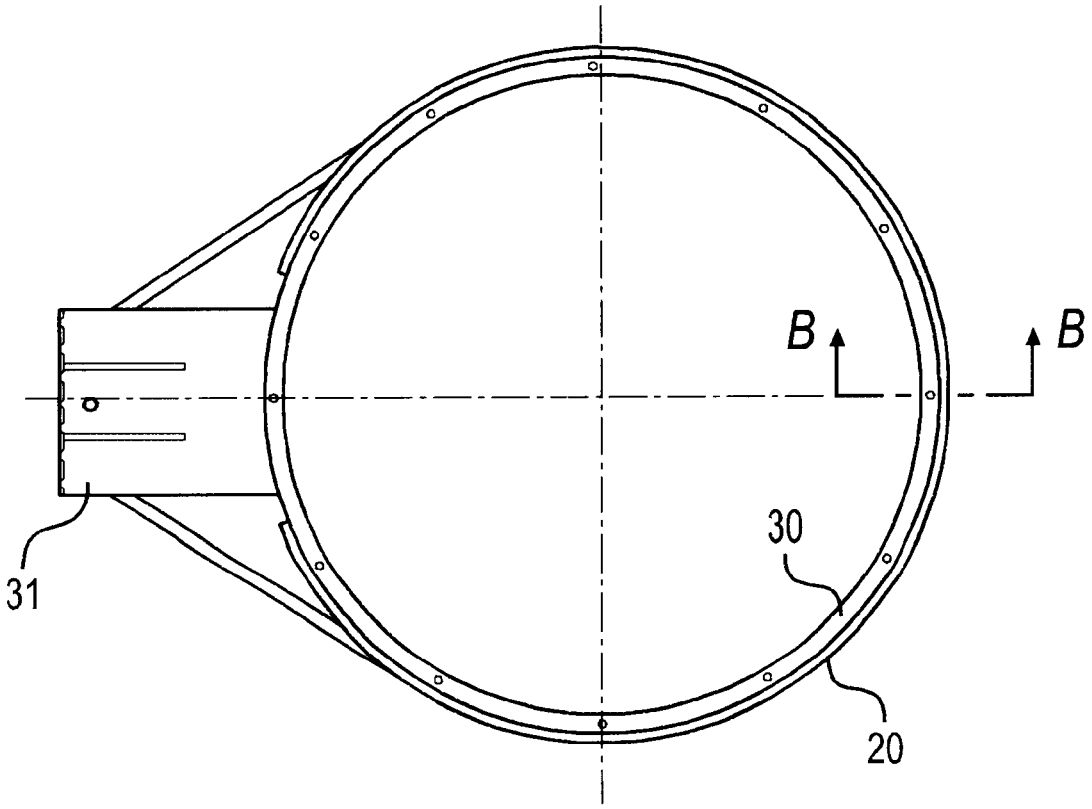
FIG. 6 is a top view of a basketball rim of an alternative embodiment of the present invention.
Figure 7:
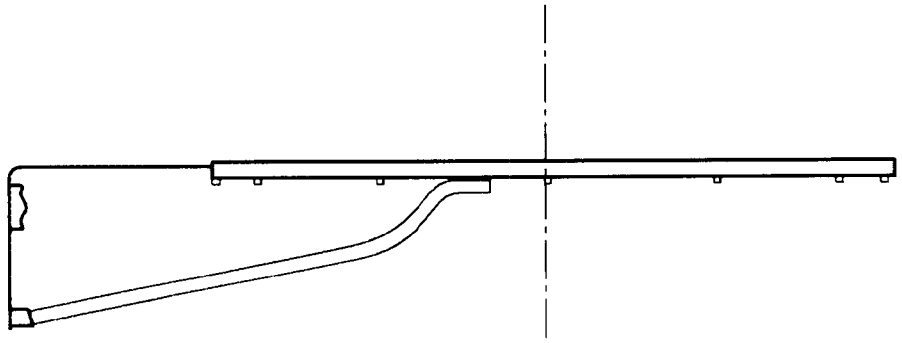
FIG. 7 is a side view of a basketball rim of an alternative embodiment of the present invention.
Figure 8:
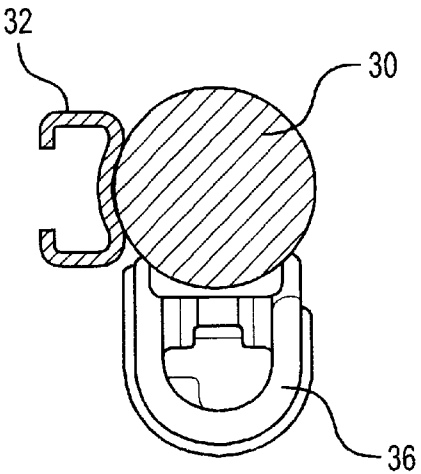
FIG. 8 is a cross-sectional view of a basketball rim of an alternative embodiment taken along cut-line B—B in FIG. 6.

FIGS. 6 and 7 show a typical basketball rim from two different perspectives. FIG. 8 shows a cross-sectional view taken along cut-line B—B. Rim 30 is substantially circular, although other shapes may be used and sizes may vary. The rim is mounted to the backboard by way of rim support 31. In this embodiment, secured to rim 30 are a plurality of net clips 36 for retaining a basketball net, and a lamp holder 32. Lamp holder 32 is preferably metal and welded about most of the circumference of rim 30. As can best be seen in the cross-sectional view of FIG. 8 and in FIG. 9, which shows a close-up view of lamp holder 32, lamp holder 32 includes a curved wall 33 which preferably is curved to match the size and shape of rim 30 so that the two pieces can be secured in a comfortable and tight fit. Lamp holder 32 further includes tongs 34*a* and 34*b* which partially enclose an area 35 designed to contain a light element to illuminate rim 30.

Figure 10:
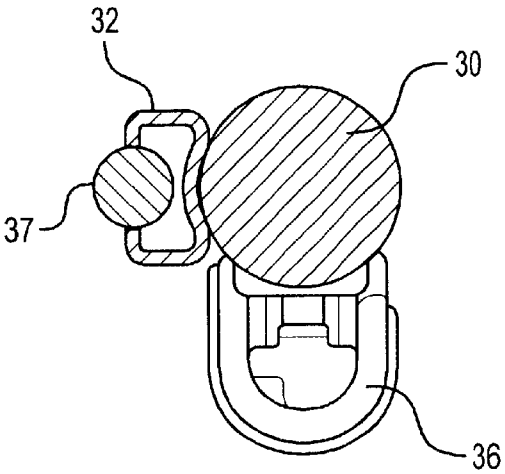
FIG. 10 is a cross-sectional view of a basketball rim of an alternative embodiment taken along cut-line B—B in FIG. 6.
Figure 9:
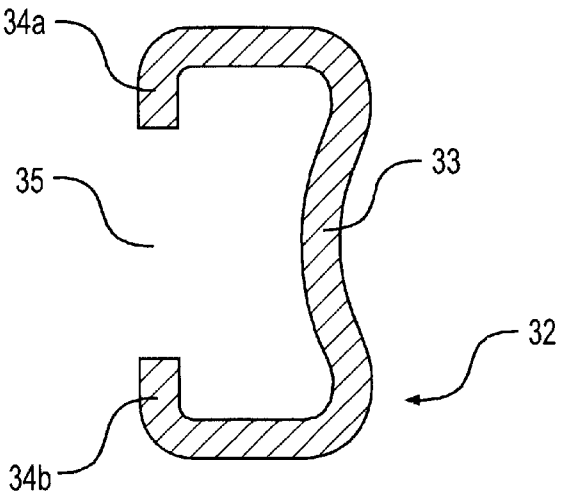
FIG. 9 is a side view of a rim lamp holder of an alternative embodiment of the present invention.

FIG. 10 shows an alternative embodiment in which a rim light element 34 has been mounted and retained within rim lamp holder 32. Rim light element 37 may consist of a flexible light conducting tube mounted about the circumference of the rim. In such an embodiment, a single light source could be place at a central position, such as somewhere beneath rim support 31, and the light conducting tube could transmit light from that light source along its length about the circumference of the rim. If the light source were battery-operated, the necessary wiring could be hidden beneath or within rim support 31 to prevent damage and the light source could be wired to battery holder 12, for example. Alternatively, more than one light source could be used to intensify the light emitted. In addition, the light source or sources could be placed at a variety of locations, such as within the light conducting tube and at various points about the rim. In another embodiment, actual lights are employed about the circumference of rim 30, rather than a light conducting tube. In this embodiment, a light cover such as a clear or translucent, ultraviolet-stabilized lamp cover may be desirable to prevent damage to the lights while permitting the maximum amount of light to be emitted. However, again, the lamp holder 32 could be employed to secure the lights and necessary wiring to the rim.

CONCLUSION

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

We claim:

1. A method of making a basketball backboard, said method comprising:

forming a frame with a raised peripheral edge from molded plastic, the peripheral edge having a first top surface and a second top surface;

treating the first top surface of the peripheral edge of the frame to make the peripheral edge more receptive to a bonding agent;

applying an adhesive material to the first top surface of the peripheral edge of the frame;

attaching an acrylic sheet having an interior and exterior surface to the first top surface of the peripheral edge of the frame by way of the adhesive material such that a cavity is defined on the front by the interior surface of the acrylic sheet, on the rear by the frame, and on the sides by the raised peripheral edge of the frame, and wherein the exterior surface of the acrylic sheet is substantially flush with the second top surface of the peripheral edge; and applying a compressive force to at least one of the frame and the acrylic sheet to facilitate said step of attaching the acrylic sheet to the frame.

2. The method of claim 1 wherein the frame is formed by at least one of injection molding, compression molding, blow molding, and roto-molding.

3. The method of claim 1 wherein said step of treating the peripheral edge involves flame treating the peripheral edge.

4. The method of claim 1 wherein said step of treating the peripheral edge involves corona treating the peripheral edge.

5. The method of claim 1 wherein said step of forming a frame further comprises forming a support structure integral with the frame and capable of supporting the acrylic sheet.

6. The method of claim 5 wherein the support structure is formed within the interior portion of the frame.

7. The method of claim 5 further comprising:

treating the support structure to make the support structure more receptive to a bonding agent;

applying an adhesive material to the support structure; and attaching the acrylic sheet to the support structure by way of the adhesive material.

8. The method of claim 7 wherein said step of treating the support structure involves flame treating the support structure.

9. The method of claim 7 wherein said step of treating the support structure involves corona treating the support structure.

10. The method of claim 1 further comprising the step of disposing a light emitting device within the cavity.

11. The method of claim 10 wherein said step of forming a frame further comprises forming a compartment in the frame, wherein the compartment is capable of retaining a battery for supplying an electrical charge to the light emitting device.

12. The method of claim 1 further comprising the step of securing a basketball rim to the frame, wherein the basketball rim comprises a rim light emitting device capable of emitting light over at least a portion of the basketball rim.

13. A method of making a lighted basketball backboard, said method comprising the steps of:

forming a frame with a raised peripheral edge from molded plastic, the peripheral edge having a first top surface and a second top surface;

treating the first top surface of the peripheral edge of the frame to make the peripheral edge more receptive to a bonding agent;

applying an adhesive material to the first top surface of the peripheral edge of the frame;

attaching an acrylic sheet having an interior and exterior surface to the first top surface of the peripheral edge of the frame by way of the adhesive material such that a cavity is defined on the front by the interior surface of the acrylic sheet, on the rear by the frame, and on the sides by the raised peripheral edge of the frame, and wherein the acrylic sheet is disposed within the peripheral edge of the frame and the exterior surface of the acrylic sheet is substantially flush with the second top surface of the peripheral edge;

applying a compressive force to at least one of the frame and the acrylic sheet to facilitate said step of attaching the acrylic sheet to the frame; and disposing a light emitting device within the cavity.

14. The method of claim 13 wherein the frame is formed by at least one of injection molding, compression molding, blow molding, and roto-molding.

15. The method of claim 13 wherein said step of treating the peripheral edge involves flame treating the peripheral edge.

16. The method of claim 13 wherein said step of treating the peripheral edge involves corona treating the peripheral edge.

17. The method of claim 13 wherein said step of forming a frame further comprises forming a support structure integral with the frame and capable of supporting the acrylic sheet.

18. The method of claim 17 wherein the support structure is formed within the interior portion of the frame.

19. The method of claim 17 further comprising the steps of:

treating the support structure to make the support structure more receptive to a bonding agent;

applying an adhesive material to the support structure; and attaching the acrylic sheet to the support structure by way of the adhesive material.

20. The method of claim 19 wherein said step of treating the support structure involves flame treating the support structure.

21. The method of claim 17 wherein said step of treating the support structure involves corona treating the support structure.

22. The method of claim 13 wherein said step of forming a frame further comprises forming a compartment in the frame, wherein the compartment is capable of retaining a battery for supplying an electrical charge to the light emitting device.

23. The method of claim 13 further comprising the step of securing a basketball rim to the frame, wherein the basketball rim comprises a rim light emitting device capable of emitting light over at least a portion of the basketball rim.

* * * * *